US008728248B2

(12) United States Patent
Boyer et al.

(10) Patent No.: US 8,728,248 B2
(45) Date of Patent: May 20, 2014

(54) ADJUSTABLE FILTER SYSTEM FOR A DISHWASHING APPLIANCE

(75) Inventors: Joel Charles Boyer, Louisville, KY (US); John Dries, Louisville, KY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 13/226,709

(22) Filed: Sep. 7, 2011

(65) Prior Publication Data

US 2013/0056029 A1 Mar. 7, 2013

(51) Int. Cl.
*B08B 3/00* (2006.01)

(52) U.S. Cl.
USPC ..... 134/58 D; 134/36 D; 134/57 D

(58) Field of Classification Search
USPC ..... 134/58 D, 56 D, 57 D
See application file for complete search history.

(56) References Cited

U.S. PATENT DOCUMENTS

| | | | | |
|---|---|---|---|---|
| 4,641,671 | A * | 2/1987 | Nogi et al. | 134/57 D |
| 6,293,289 | B1 * | 9/2001 | Hapke et al. | 134/58 D |
| 7,055,795 | B2 * | 6/2006 | Lay | 251/129.03 |
| 7,195,023 | B2 | 3/2007 | McKee et al. | |
| 7,350,527 | B2 | 4/2008 | Gurubatham et al. | |
| 7,472,712 | B2 | 1/2009 | Ashton et al. | |
| 2011/0056527 | A1 * | 3/2011 | Classen et al. | 134/56 D |

FOREIGN PATENT DOCUMENTS

WO WO 2009/077286 A1 * 6/2009 ..... A47L 15/42

* cited by examiner

*Primary Examiner* — Joseph L Perrin
*Assistant Examiner* — Levon J Shahinian
(74) *Attorney, Agent, or Firm* — Dority & Manning, P.A.

(57) ABSTRACT

An adjustable filter system for a dishwashing appliance is provided. More specifically, a filter system is provided whereby the relative amount of fluid filtered by two different filters can be selectively controlled during operation of the dishwashing appliance. Flow can be directed primarily to one filter or the other depending upon the size of the soil particles expected at certain times during the cleaning process. Selection can be e.g., based on the temperature of fluid used in the appliance or determined by a controller.

18 Claims, 9 Drawing Sheets

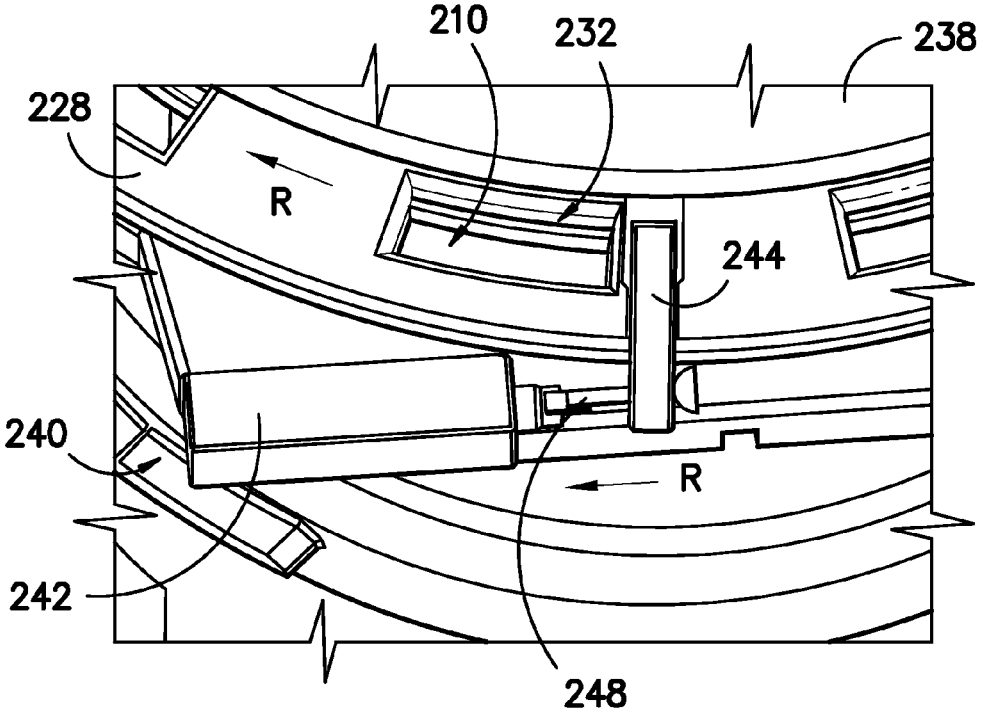
FIG. –8–
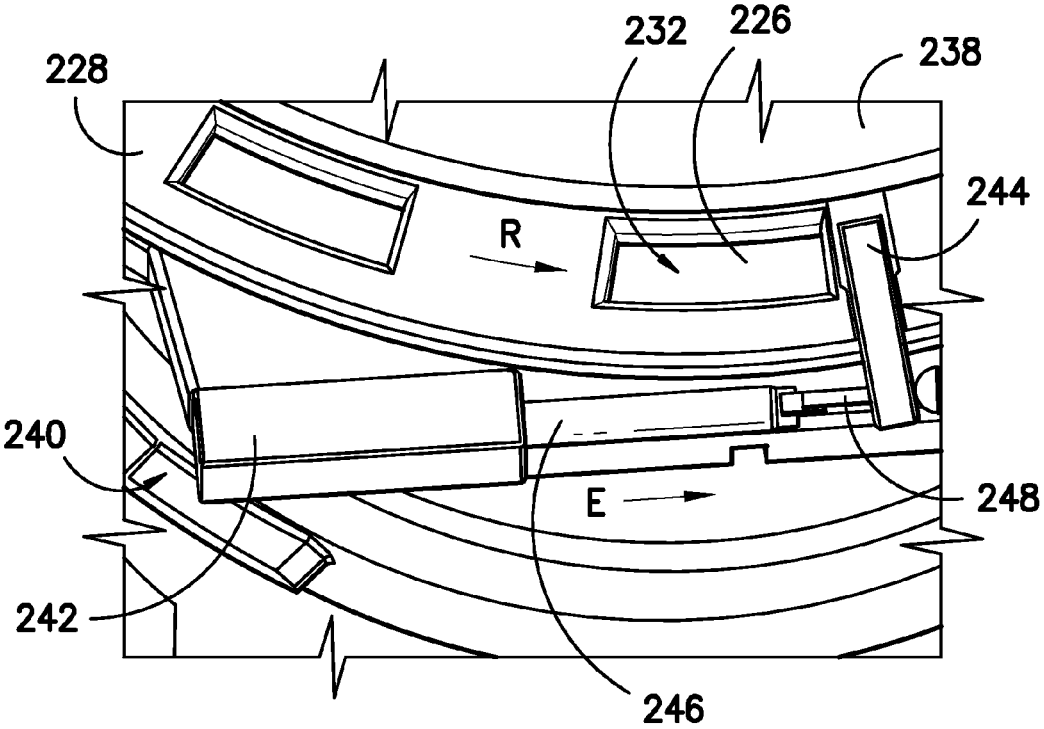
FIG. –9–

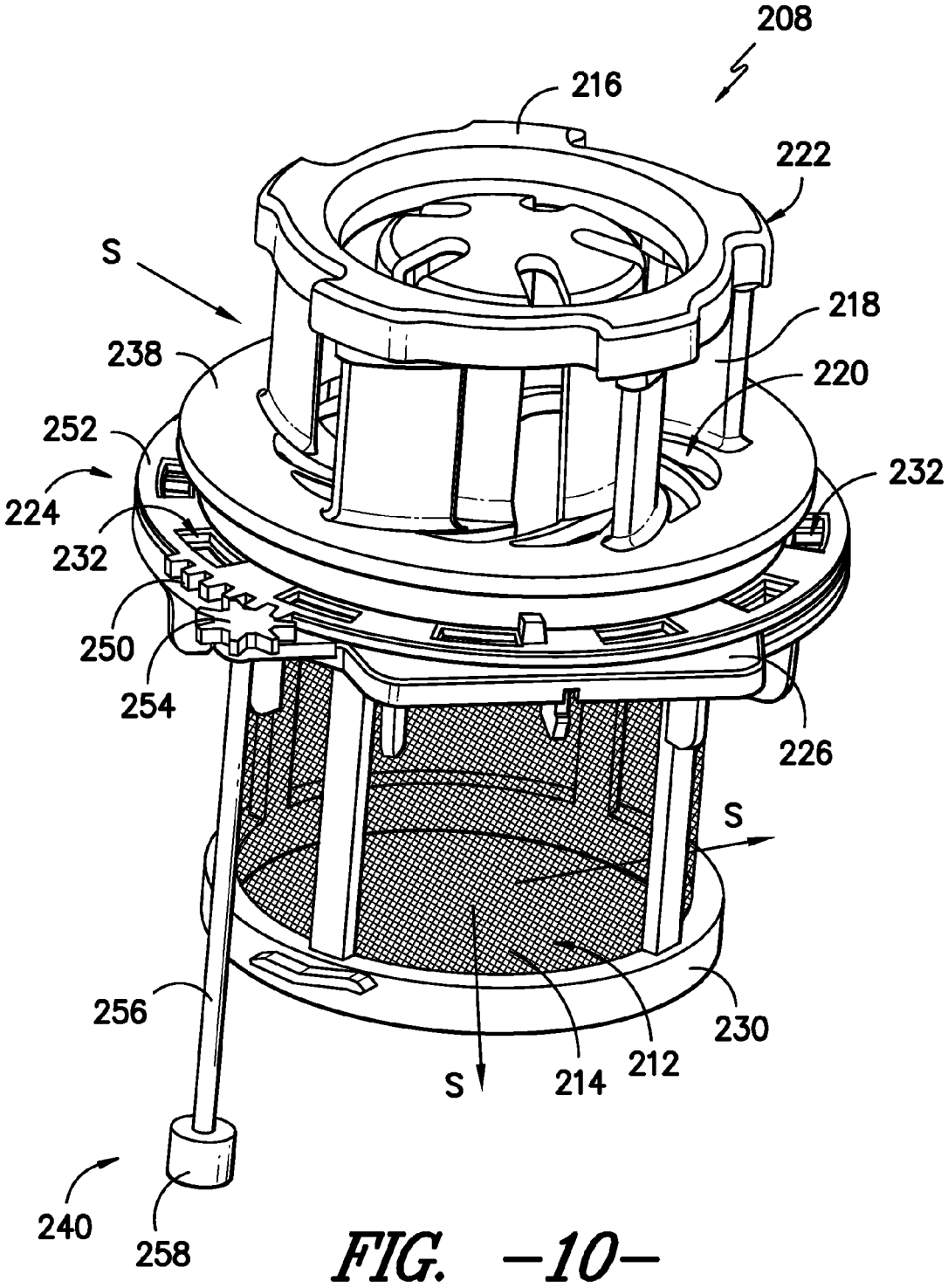
FIG. —10—

ADJUSTABLE FILTER SYSTEM FOR A DISHWASHING APPLIANCE

FIELD OF THE INVENTION

The subject matter of the present invention relates to an adjustable filter for a dishwashing appliance.

BACKGROUND OF THE INVENTION

During wash and rinse cycles, dishwashers typically circulate a fluid through the wash chamber and over articles such as pots, pans, silverware, and other cooking utensils. The fluid can be e.g., various combinations of water and detergent during the wash cycle or water (which may include additives) during the rinse cycle. Typically the fluid is recirculated during a given cycle using a pump. Fluid is collected at or near the bottom of the wash chamber and pumped back into the chamber through e.g., nozzles in the spray arms and other openings that direct the fluid against the articles to be cleaned or rinsed.

Depending upon the level of soil upon the articles, the fluid will become contaminated with the soil in the form of debris and particles that are carried with the fluid. In order to protect the pump and make sure the fluid can continue to recirculate through the wash chamber, the fluid is typically filtered during its movement between the wash chamber and the pump so that relatively clean fluid is supplied to the pump inlet. In addition to pump protection, such filtration also helps to clean the articles by removing soil from the fluid.

During the overall cleaning process, larger soil particles are typically present at the beginning of the process. As soil is removed by filtration of the fluid between the wash chamber and the pump during recirculation, the amount and size of particles in the recirculated fluid will decrease. Accordingly, generally the amount and size of particles carried by the fluid will be smaller towards e.g., the end of the wash cycle and can be even smaller towards the end of the rinse cycle.

For mechanical filtration, the selectivity of the filter to remove soil particles of different sizes is typically determined by providing fluid paths (such as pores or apertures) in the filter that are smaller than the particles for which filtration is desired. Particles having a dimension larger than the width of the fluid paths will be prevented from passing through the filter while particles smaller than the width of the fluid path will generally pass through. While a filter capable of capturing a majority of both the larger and smaller soil particles could be used throughout the entire cleaning process by using a small pore filter (e.g., a fine filter), such would come at an increased pressure drop as both large and small soil particles would become entrained in the filter from the beginning of the cleaning cycle. The filter could even become completely clogged and/or increased energy may be required to move fluid through the filter. A filter having larger pores can be used (e.g., a coarse filter) and less pressure drop would be expected, but smaller soil particles will generally pass through and remain in the fluid to negatively impact the cleaning process.

Accordingly, a filter system for a dishwasher would be beneficial. More specifically, a filter system for a dishwasher that can provide for effective filtration of both large and small particles during the entire cleaning process would be useful. Such a filter system that can change the amount of flow between different filters during the cleaning process so that both coarse and fine filters may be used at different stages of the cleaning cycle would be particularly beneficial.

BRIEF DESCRIPTION OF THE INVENTION

Aspects and advantages of the invention will be set forth in part in the following description, or may be obvious from the description, or may be learned through practice of the invention.

In one exemplary embodiment of the present invention, a dishwashing appliance is provided that includes a cabinet defining a wash chamber for the receipt of articles for washing. A pump is configured for the receipt of a fluid to be recirculated into the wash chamber of the cabinet. The pump has an inlet. A first filter is configured for filtering fluid from the wash chamber prior to feeding such fluid to the inlet of the pump. A second filter is configured for filtering fluid from the wash chamber prior to feeding such fluid to the inlet of the pump. A valve is provided that includes a fixed annular portion that defines a first aperture for the flow through of fluid from the first filter and a rotatable annular portion that defines a second aperture for the flow through of fluid from the first filter. The rotatable annular portion is rotatable relative to the fixed annular portion and located adjacent to the fixed annular portion such that the first aperture and the second aperture can be selectively aligned for the flow therethrough of fluid. An actuator is connected with the rotatable annular portion and configured for rotating the rotatable annular portion relative to the fixed annular portion to determine the amount of alignment of the first aperture and the second aperture such that the relative amounts of fluid flowing through the first filter and the second filter may be selectively determined.

In another exemplary embodiment, the present invention provides a method for filtering fluid in a dishwashing appliance. The appliance has a wash chamber and a pump for recirculating fluid to the wash chamber. The appliance also has a first filter, a second filter, and a valve that includes a rotatable, annular portion having at least one aperture. The method comprises the steps of recirculating a fluid through the wash chamber, the first and second filter, the pump, and then back to the wash chamber; rotating the annular portion of the valve so as to change the position of the at least one aperture; and changing the ratio of the amount of fluid flowing through the first filter and the second filter based on the position of the at least one aperture.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which:

FIGS. 8 and 9 illustrate an exemplary embodiment of an actuator as may be used with present invention with FIG. 8 showing a retracted position and FIG. 9 showing an extended position.

FIG. 10 provides another exemplary embodiment of an actuator configured with the filter and valve of FIGS. 5 and 6.

DETAILED DESCRIPTION OF THE INVENTION

Figure 1:
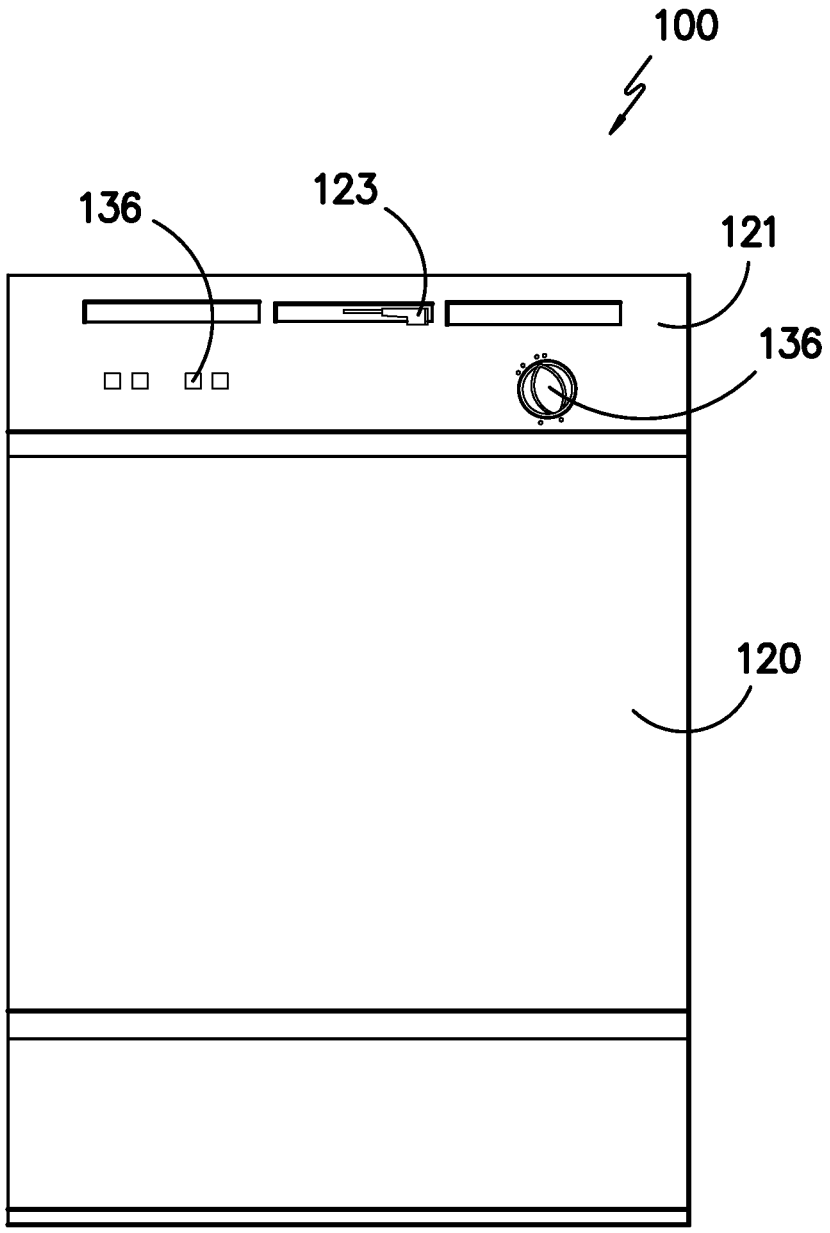
FIG. 1 provides a front view of an exemplary embodiment of a dishwashing appliance as may be used with the present invention.

The present invention provides an adjustable filter system for a dish washing appliance. More specifically, a filter system is provided whereby the relative amount of fluid filtered by two different filters can be selectively controlled during operation of the dishwashing appliance. Flow can be directed primarily to one filter or the other depending upon the size of the soil particles expected at certain times during the cleaning process. Selection can be e.g., based on the temperature of fluid used in the appliance or determined by a controller.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "article" may refer to but need not be limited to dishes, pots, pans, silverware, and other cooking utensils and items that can be cleaned in a dishwashing appliance. The term "wash cycle" is intended to refer to one or more periods of time during which a dishwashing appliance operates while containing the articles to be washed and uses a detergent and water, preferably with agitation, to e.g., remove soil particles including food and other undesirable elements from the articles. The term "rinse cycle" is intended to refer to one or more periods of time in which the dishwashing appliance operates to remove residual soil, detergents, and other undesirable elements that were retained by the articles after completion of the wash cycle. The term "fluid" refers to a liquid used for washing and/or rinsing the articles and is typically made up of water that may include other additives such as detergent or other treatments.

Figure 2:
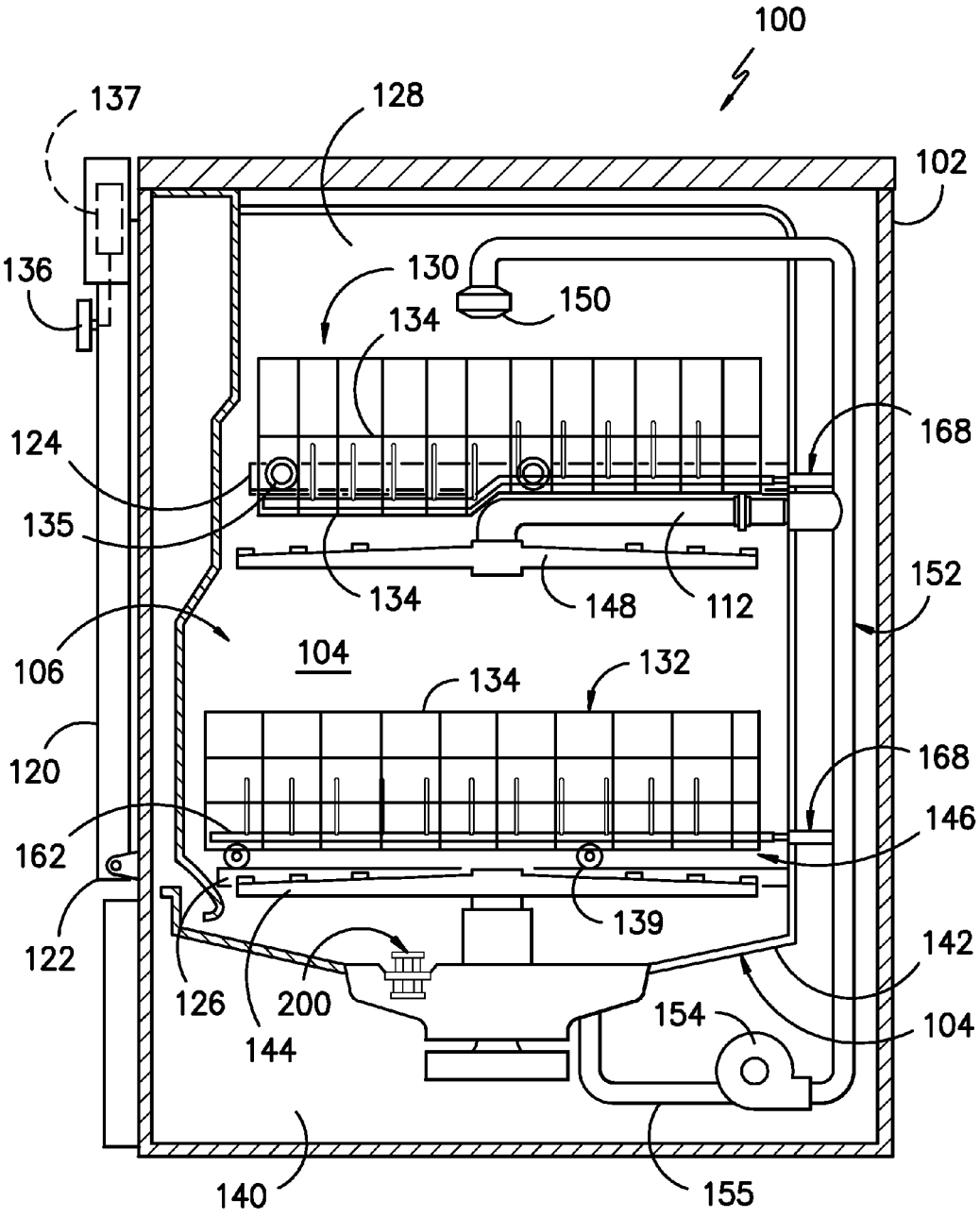
FIG. 2 is a cross-sectional view of the exemplary embodiment of a dishwashing appliance shown in FIG. 1.

FIGS. 1 and 2 depict an exemplary domestic dishwasher 100 that may be configured in accordance with aspects of the present disclosure. For the particular embodiment of FIG. 1, the dishwasher 100 includes a cabinet 102 having a tub 104 therein that defines a wash chamber 106. The tub 104 includes a front opening (not shown) and a door 120 hinged at its bottom 122 for movement between a normally closed vertical position (shown in FIGS. 1 and 2), wherein the wash chamber 106 is sealed shut for washing operation, and a horizontal open position for loading and unloading of articles from the dishwasher. Latch 123 is used to lock and unlock door 120 for access to chamber 106.

Upper and lower guide rails 124, 126 are mounted on tub side walls 128 and accommodate roller-equipped rack assemblies 130 and 132. Each of the rack assemblies 130, 132 is fabricated into lattice structures including a plurality of elongated members 134 (for clarity of illustration, not all elongated members making up assemblies 130 and 132 are shown in FIG. 2). Each rack 130, 132 is adapted for movement between an extended loading position (not shown) in which the rack is substantially positioned outside the wash chamber 106, and a retracted position (shown in FIGS. 1 and 2) in which the rack is located inside the wash chamber 106. This is facilitated by rollers 135 and 139, for example, mounted onto racks 130 and 132, respectively. A silverware basket (not shown) may be removably attached to rack assembly 132 for placement of silverware, utensils, and the like, that are otherwise too small to be accommodated by the racks 130, 132.

The dishwasher 100 further includes a lower spray-arm assembly 144 that is rotatably mounted within a lower region 146 of the wash chamber 106 and above a tub sump portion 142 so as to rotate in relatively close proximity to rack assembly 132. A mid-level spray-arm assembly 148 is located in an upper region of the wash chamber 106 and may be located in close proximity to upper rack 130. Additionally, an upper spray assembly 150 may be located above the upper rack 130.

The lower and mid-level spray-arm assemblies 144, 148 and the upper spray assembly 150 are fed by a fluid circulation assembly 152 for circulating water and dishwasher fluid in the tub 104. The fluid circulation assembly 152 may include a pump 154 located in a machinery compartment 140 located below the bottom sump portion 142 of the tub 104, as generally recognized in the art. Each spray-arm assembly 144, 148 includes an arrangement of discharge ports or orifices for directing washing liquid onto dishes or other articles located in rack assemblies 130 and 132. The arrangement of the discharge ports in spray-arm assemblies 144, 148 provides a rotational force by virtue of washing fluid flowing through the discharge ports. The resultant rotation of the lower spray-arm assembly 144 provides coverage of dishes and other dishwasher contents with a washing spray.

The dishwasher 100 is further equipped with a controller 137 to regulate operation of the dishwasher 100. The controller may include a memory and one or more microprocessors, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor.

The controller 137 may be positioned in a variety of locations throughout dishwasher 100. In the illustrated embodiment, the controller 137 may be located within a control panel area 121 of door 120 as shown. In such an embodiment, input/output ("I/O") signals may be routed between the control system and various operational components of dishwasher 100 along wiring harnesses that may be routed through the bottom 122 of door 120. Typically, the controller 137 includes a user interface panel 136 through which a user may select various operational features and modes and monitor progress of the dishwasher 100. In one embodiment, the user interface 136 may represent a general purpose I/O ("GPIO") device or functional block. In one embodiment, the user interface 136 may include input components, such as one or more of a variety of electrical, mechanical or electromechanical input devices including rotary dials, push buttons, and touch pads. The user interface 136 may include a display component, such as a digital or analog display device designed to provide operational feedback to a user. The user interface 136 may be in communication with the controller 137 via one or more signal lines or shared communication busses.

Figure 3:
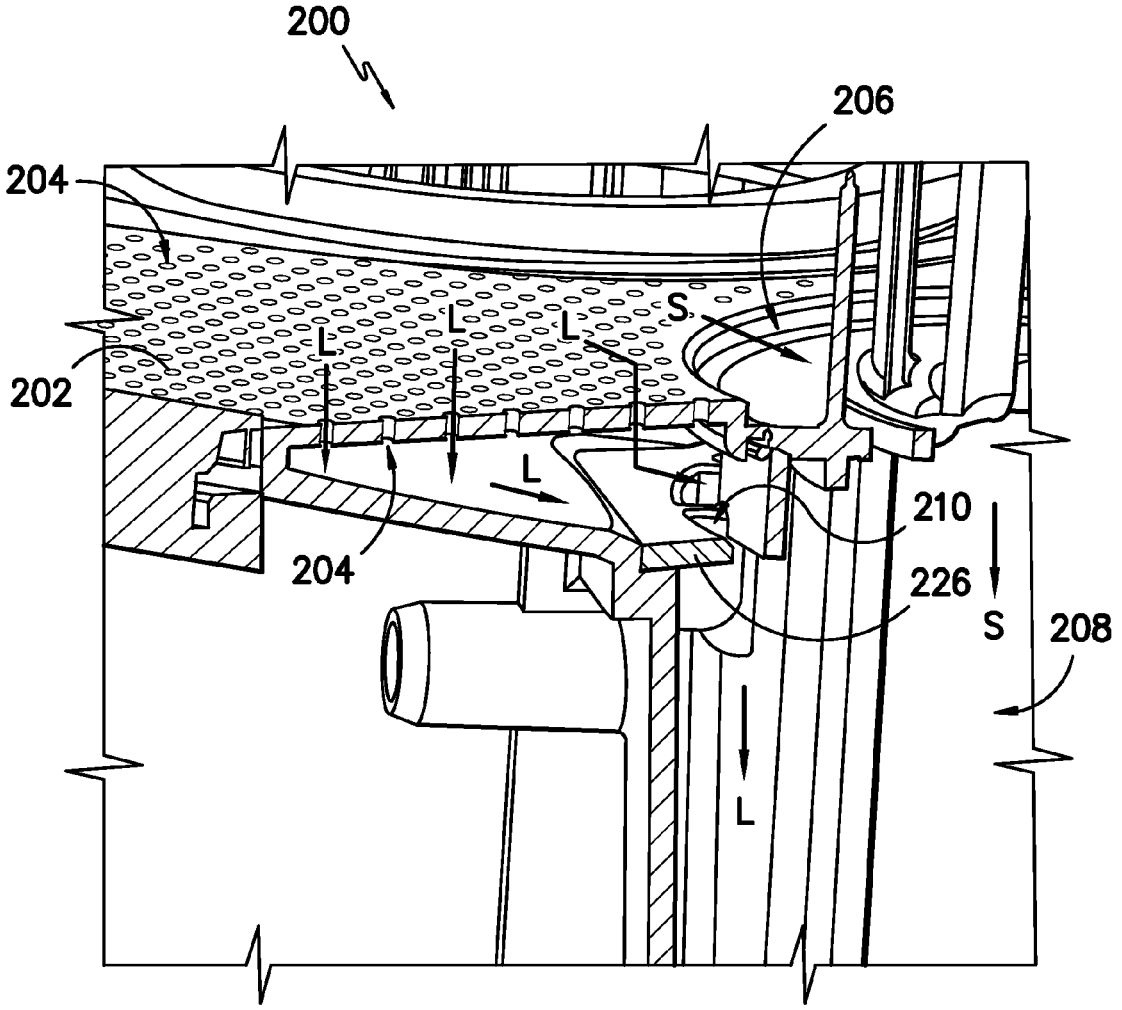
FIG. 3 is a partial, cross-sectional view taken near the sump portion of the exemplary dishwashing appliance of FIG. 1 and illustrating part of an exemplary embodiment of a filtering system of the present invention. For purposes of clarity in illustration, FIG. 3 does not include the rotatable portion of valve as further described herein.

Referring now specifically to FIGS. 2 and 3, an exemplary embodiment of a filtering system 200 is located in sump portion 142 (for purposes of clarity, FIG. 3 does not show the rotatable portion of a valve that will be described and illustrated further below). Filtering system 200 removes large and small soil particles from the fluid that is recirculated through the wash chamber 106 during operation of dishwasher 100. After the fluid is filtered, it is fed to the inlet 155 of pump 154 for return to the wash chamber 106 by way of fluid circulation assembly 152. Accordingly, filtering system 200 acts to clean soil particles from the fluid and protect pump 154 from clogging as the fluid is recirculated during e.g., a wash or rinse cycle of dishwasher 100.

Figure 4:
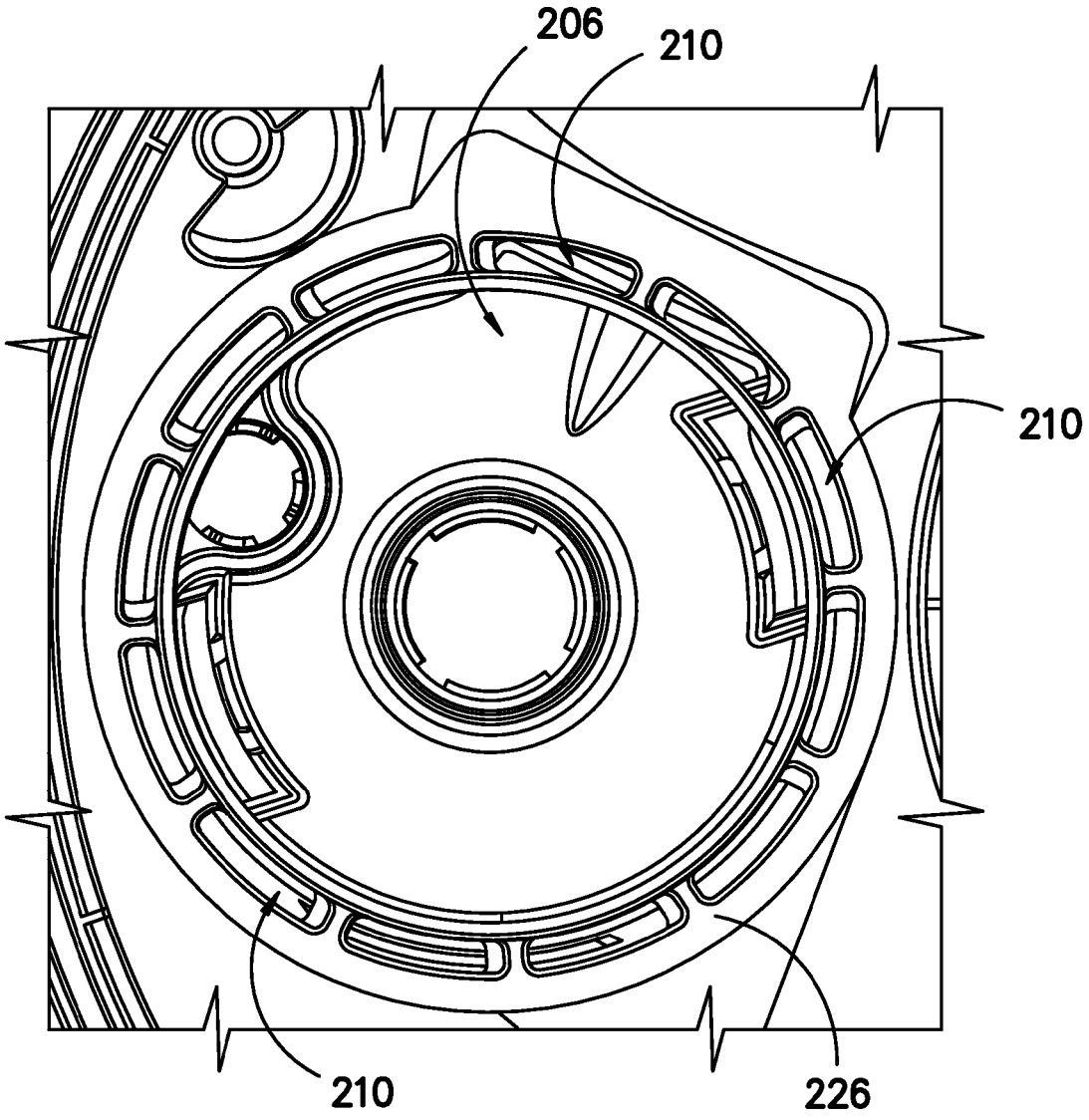
FIG. 4 is a view, from the top, of the fixed portion of an exemplary embodiment of a valve of the present invention—as positioned at the sump portion of the exemplary dishwashing appliance of FIGS. 1 and 2.

Filtering system 200 includes a first filter 202 that is constructed as a grate located in the sump portion 142 and has a plurality of relatively large apertures 204, which allows the fluid and particles smaller than apertures 204 to pass through as indicated by arrows L. This fluid continues to flow towards and through a plurality of first apertures 210. The filtered fluid is then returned to the inlet 155 of pump 154 (FIG. 1) for recirculation. First filter 202 surrounds an opening 206 (FIG. 3 and FIG. 4) into which a second filter 208 (FIGS. 3, 5, 6, and 10) is removably received. As shown by arrows S, fluid can also pass into second filter 208, which will be described further below. Second filter 208 is configured to remove smaller particles from the fluid that generally cannot be removed by first filter 202. Accordingly, fluid from e.g., sprays arms 144 and 148 as well as spray assembly 150 travels over articles in wash chamber 106 and down to sump portion 142 carrying soil particles from the articles for removal by filtering system 200. As will now be further described, the prevent invention provides for controlling the relative amounts of fluid flow through the first filter 202 and the second filter 208 so that filtering system 200 can be tuned or adjusted depending upon the soil particle size that is anticipated at different times in the overall cleaning process—including the wash cycle(s) and the rinse cycle(s).

Figure 5:
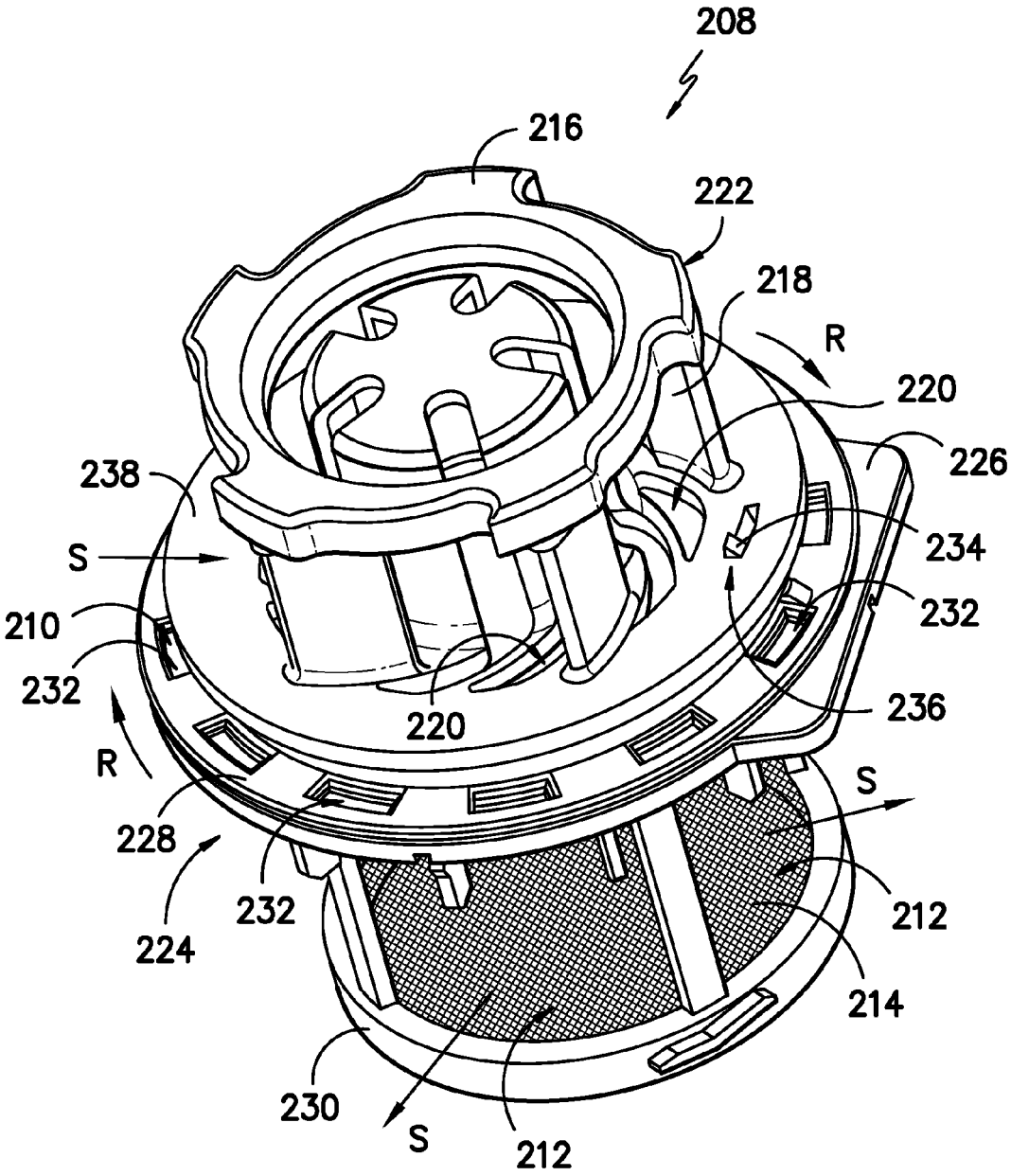
FIGS. 5 and 6 are perspective views of an exemplary embodiment of a filter configured with an exemplary valve of the present invention.

FIG. 5 provides a perspective view of an exemplary embodiment of second filter 208. As shown, second filter 208 includes a housing 230 having windows 212 for the flow therethrough of a fluid as shown by arrows S. Each window 212 provides a frame for a filter media constructed as a fine mesh 214 that captures relatively smaller particles from the fluid. A top 222 on second filter 208 includes a handle 216 that is supported by a plurality of impellers 218, which help direct the flow of fluid towards the second filter 208 through a plurality of slots 220. Handle 216 allows for the removal of second filter 208 from opening 206 for purposes of replacement or cleaning. As will be understood using the teachings disclosed herein, second filter 208 is provided by way of example only. Other configurations of second filter 208 could be used as well including different types of filter media and different constructions for housing 230.

Second filter 208 is encircled by a valve 224 that includes a fixed annular portion 226 and a rotatable annular portion 228. Fixed annular portion 226 defines the plurality of first apertures 210 (FIGS. 3, 4, and 5) through which the fluid flows from first filter 202 (arrows L in FIG. 3). Rotatable annular portion 228 defines a plurality of second apertures 232 through which fluid from first filter 202 also flows before passing through the plurality of first apertures 210. Rotatable annular portion 228 is located adjacent to, and just above, annular portion 226 and is rotatable relative to annular portion 226. Accordingly, by rotating annular portion 228, the position of apertures 210 relative to apertures 232 may be controlled. More specifically, apertures 210 and 232 can be aligned as desired to control the amount of fluid flow therethrough.

Figure 6:
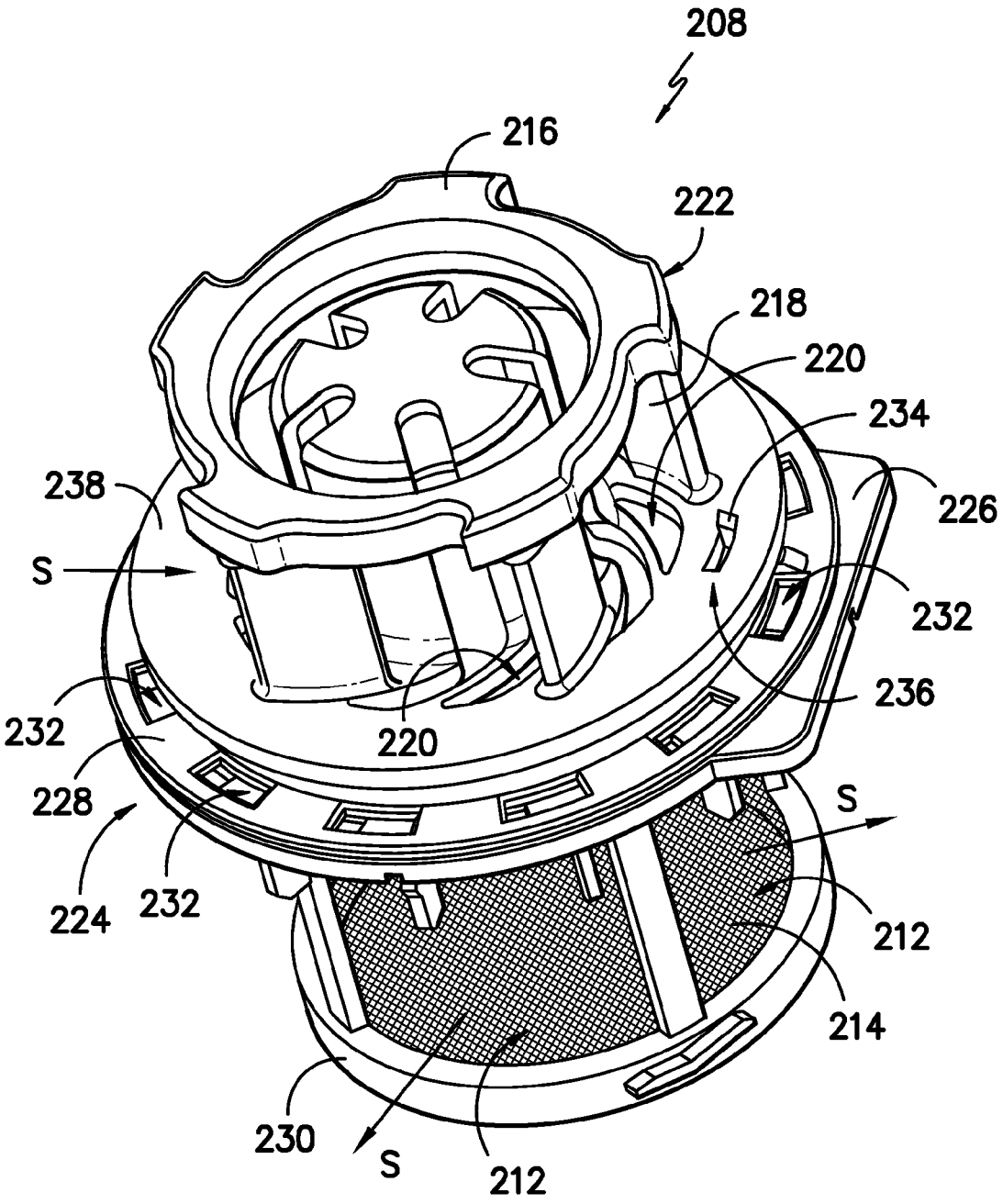

For example, in FIG. 6 rotatable annular portion 228 is at a position relative to fixed annular portion 226 such that apertures 210 and 232 are misaligned. Accordingly, the flow of fluid through apertures 210 and 232 is partially blocked in this position. As a result, for this position, the flow of fluid from wash chamber 106 is primarily through second filter 208 as depicted by arrows S in FIG. 3. Conversely, in FIG. 5, the rotatable annular portion 228 has been rotated (arrows R) to a different position relative to fixed annular portion 226 such that apertures 210 and 232 are aligned with each other. In this position, the flow of fluid from wash chamber 106 is primarily through first filter 202. As such, for this exemplary embodiment of the present invention, filtering system 200 does not completely block the flow of fluid through either first filter 202 or second filter 208 at any one time. Instead, through selective alignment of apertures 210 and 232, the ratio or relative amounts of fluid flowing through filters 202 and 208 at any one time can be controlled.

Annular portions 226 and 228 are provided by way of example only. Using the teachings disclosed herein, one of skill in the art will understand that through e.g., modifications to the shape or positioning of apertures 210 and 232 on annular portions 226 and 228, respectively, the total amount of flow through first filter 202 and/or second filter 208 can be changed. For example, by making apertures 210 and 232 larger than what is shown in FIGS. 5 and 6, more fluid will pass though when these apertures are fully aligned with each other. Similarly, apertures 210 and 232 can be configured to completely block the flow of fluid when these are apertures are not aligned. Other modifications can be undertaken as well.

Figure 7:
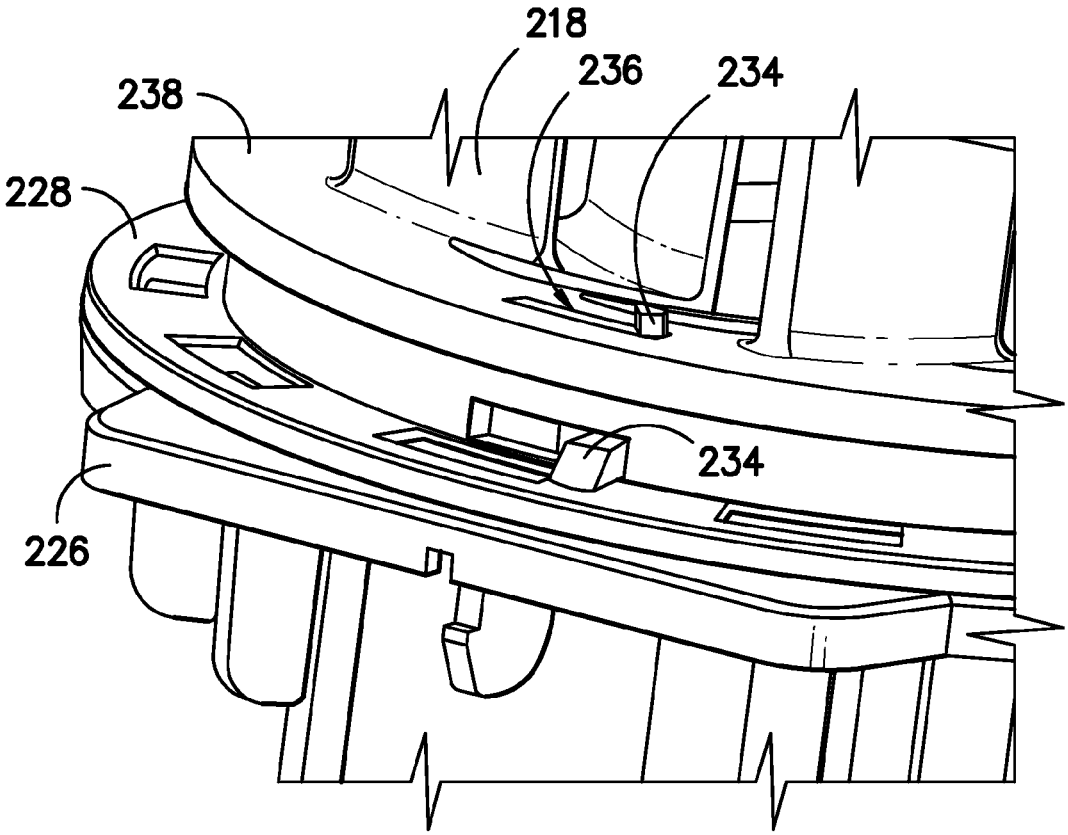
FIG. 7 provides a partial perspective view of an exemplary mechanism used to control the amount of rotation of an annular portion of the exemplary valve of FIGS. 5 and 6.

As shown in FIGS. 5 through 7, rotatable annular portion 228 includes a projection or boss 234 that is received into a slot 236 defined by base 238. Accordingly, as shown in FIGS. 5 and 6, base 234 and slot 236 limit the overall amount of rotation of rotatable annular portion 228 relative to fixed annular portion 226. Additionally, boss 234 can also provide a visual indication of the position of rotatable annular portion 228. Indicia can be provided next to slot 236 to identify such positions.

A variety of mechanisms can be used to provide for causing the rotatable annular portion 228 to rotate relative to fixed annular portion 226. FIGS. 8 and 9 provide an exemplary embodiment of an actuator 240 as may be used with the present invention. For this particular embodiment, actuator 240 is configured as a wax motor 242 connected to an arm 244 on portion 228 by a plunger 246 and a shaft 248. During operation of the dishwashing appliance 100, certain portions of the cleaning process will use a heated fluid. For example, during a final portion of a rinse cycle when the fluid is relatively free from soil particles (or e.g., contains mostly fine or small soil particles), the fluid typically will be relatively hotter than earlier portions of the rinse cycle. As such, sufficient heat will be transferred to wax motor 242 to cause expansion of the wax contained therein, which will extend plunger 246 as shown by arrow E in FIG. 9. As a result, annular portion 228 will rotate as shown by arrow R so that apertures 210 and 232 are no longer fully aligned. More specifically, the rotation of annular portion 228 will cause fixed annular portion 226 to partially or fully block apertures 232 in annular portion 228. In this position, more or the fluid flow will be directed to second filter 208 for the removal of any of the smaller soil particles that might be present.

Conversely, when wax motor 242 cools, the wax container therein will contract. An internal spring (not shown) will return plunger 246 to an unextended position as shown in FIG. 6. In this unextended position, the first plurality of apertures 210 on the fixed annular portion 226 are aligned with the second plurality of apertures 232 on the rotatable annular portion 228, and more of the fluid will be directed to the first filter 202 for the removal of the larger soil particles. Again, for this exemplary embodiment of filtering system 200, flow occurs through both the first filter 202 and second filter 208 at any one time while filtering system 200 controls the relative amounts of fluid allowed through each filter. In other exemplary embodiments, for example, filtering system 200 could be constructed to completely block flow through the first filter 202 if desired.

FIG. 10 provides another exemplary embodiment of an actuator 240 as may be used with the present invention. For this embodiment, rotatable annular portion 228 has a plurality of gear teeth positioned along a circumferential edge 252. A spur gear 254 is attached to a shaft 256 extending from motor 258. Accordingly, the operation of motor 258 to rotate shaft 256 in a selected direction can be used to rotate annular portion 228 and thereby select the amount of flow between first filter 202 and second filter 208 as previously described. Controller 137 can be programmed to communicate with actuator (e.g., activate actuator 240, operate actuator, or otherwise control actuator 240) so as to selectively position rotatable annular portion 228 as desired at a particular time in the cleaning process.

For example, controller 137 could be programmed to cause actuator 240 to position rotatable annular portion 228 so that first and second apertures are aligned during a wash cycle and non-aligned during all or later portions of a rinse cycle. In this case, the recirculated fluid with larger soil particles can be directed to the first filter 202 at the beginning of the cleaning process, and then the fluid can be directed primarily to the second filter 208 towards the end of the cleaning process—when fewer particles and primarily smaller soil particles will be present. For example, substantially more fluid might be directed to the first filter 202 during the wash cycle while substantially more fluid is directed to the second filter 208 during all or later portions of the rinse cycle. Regardless, the controller can be configured to control the actuator 140 so as to adjust the ratio of the amounts of fluid flowing through first filter 202 and second filter 208 at any time during operation of the appliance.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwashing appliance, comprising:

a cabinet defining a wash chamber for the receipt of articles for washing, the wash chamber having a sump portion, the sump portion having an opening;

a pump configured for the receipt of a fluid to be recirculated into the wash chamber of said cabinet, said pump having an inlet;

a first filter located in the sump portion and configured for filtering fluid from the wash chamber prior to feeding such fluid to the inlet of said pump;

a second filter removably received in the opening in the sump portion and configured for filtering fluid from the wash chamber prior to feeding such fluid to the inlet of said pump;

a valve located in the sump portion and positioned upstream of the inlet of said pump, said valve comprising a fixed annular portion that defines a first aperture for the flow through of fluid from said first filter;

a rotatable annular portion that encircles the second filter and defines a second aperture for the flow through of fluid from said first filter, the rotatable annular portion being rotatable relative to the fixed annular portion and located adjacent to the fixed annular portion such that the first aperture and the second aperture can be selectively aligned for the flow therethrough of fluid; and an actuator connected with said rotatable annular portion and configured for rotating the rotatable annular portion relative to the fixed annular portion to determine the amount of alignment of the first aperture and the second aperture such that the relative amounts of fluid flowing through said first filter and said second filter may be selectively determined.

2. A dishwashing appliance as in claim 1, wherein said actuator comprises a wax motor.

3. A dishwashing appliance as in claim 1, wherein the rotatable annular portion comprises gear teeth along a circumferential edge of the rotatable annular portion, and wherein said actuator comprises an electric motor having a shaft extending towards the rotatable portion of said valve;

a spur gear attached to the shaft of said electric motor, said spur gear positioned in contact with the gear teeth of the rotatable annular portion such that said electric motor can rotate the rotatable annular portion relative to the fixed annular portion.

4. A dishwashing appliance as in claim 1, wherein said first filter comprises a grate located at the bottom of the wash chamber that defines a plurality of apertures for the pass through of the fluid.

5. A dishwashing appliance as in claim 4, wherein said grate surrounds an opening into which said second filter is removably received.

6. A dishwashing appliance as in claim 5, wherein said second filter defines a housing having a window for the flow therethrough of fluid, said second filter also comprising a filter media positioned at the window.

7. A dishwashing appliance as in claim 1, wherein said first filter is configured for the removal of relatively larger particles from the fluid circulated through the wash chamber, and wherein said second filter is configured for the removal of relatively smaller particles from the fluid circulated through the wash chamber.

8. A dishwashing appliance as in claim 1, wherein said actuator is activated by the transfer of heat to or from said actuator so as to cause the rotation of the rotatable annular portion of said valve.

9. A dishwashing appliance as in claim 1, further comprising:

at least one controller in communication with said actuator, said controller configured for causing said actuator to rotate at one or more predetermined times during a wash cycle, a rinse cycle, or both.

10. A dishwashing appliance as in claim 1, wherein said first filter is equipped for filtering relatively larger soil particles from fluid received from the wash chamber while said second filter is equipped for filtering relatively smaller soil particles from fluid received from the wash chamber, and wherein said appliance further comprises:

a controller in communication with said actuator, said controller configured for controlling the actuator so that the first aperture and the second aperture are aligned during a wash cycle of the appliance, said controller further configured for controlling the actuator so that the first aperture and the second aperture are not aligned during at least a portion of a rinse cycle of the appliance.

11. A dishwashing appliance as in claim 1, wherein said first filter is equipped for filtering relatively larger soil particles from fluid received from the wash chamber while said second filter is equipped for filtering relatively smaller soil particles from fluid received from the wash chamber, and wherein said appliance further comprises:

a controller in communication with said actuator, said controller configured for controlling the actuator to adjust the ratio of the amounts of fluid flowing through said first filter and said second filter during the operation of the appliance.

12. A dishwashing appliance as in claim 1, wherein said first filter is equipped for filtering relatively larger soil particles from fluid received from the wash chamber while said second filter is equipped for filtering relatively smaller soil particles from fluid received from the wash chamber, and wherein said appliance further comprises:

a controller in communication with said actuator, said controller configured for causing the actuator to rotate the rotatable annular portion so that a substantial portion of fluid flows through the first filter during a wash cycle of the appliance, said controller also configured for causing the actuator to rotate the rotatable annular portion so that a substantial portion of fluid flows through the second filter during at least part of a rinse cycle of the appliance.

13. A dishwashing appliance, comprising:

a cabinet defining a wash chamber for the receipt of articles for washing, the wash chamber having a sump portion, the sump portion having an opening;

a pump configured for the receipt of a fluid to be recirculated into the wash chamber of said cabinet, said pump having an inlet;

a first filter located in the sump portion and configured for filtering fluid from the wash chamber prior to feeding such fluid to the inlet of said pump;

a second filter positioned in the opening in the sump portion and configured for filtering fluid from the wash chamber prior to feeding such fluid to the inlet of said pump, the second filter having a fluid inlet positioned to receive fluid from the sump portion that does not flow into the first filter;

a valve located at the opening in the sump portion and positioned upstream of the inlet of said pump, said valve comprising a fixed annular portion that defines a first aperture for the flow through of fluid from said first filter;

a rotatable annular portion that defines a second aperture for the flow through of fluid from said first filter, the rotatable annular portion being rotatable relative to the fixed annular portion and located adjacent to the fixed annular portion such that the first aperture and the second aperture can be selectively aligned for the flow therethrough of fluid; and an actuator connected with said rotatable annular portion and configured for rotating the rotatable annular portion relative to the fixed annular portion to determine the amount of alignment of the first aperture and the second aperture such that the relative amounts of fluid flowing through said first filter and said second filter may be selectively determined.

14. A dishwashing appliance, comprising:

a cabinet defining a wash chamber for the receipt of articles for washing, the wash chamber having a sump portion, the sump portion having an opening;

a pump configured for the receipt of a fluid to be recirculated into the wash chamber of said cabinet, said pump having an inlet;

a grate located in the sump portion, the grate defining a first filter for filtering fluid from the wash chamber prior to feeding such fluid to the inlet of said pump;

a second filter positioned in the opening in the sump portion and configured for filtering fluid from the wash chamber prior to feeding such fluid to the inlet of said pump;

a valve located at the opening in the sump portion and positioned upstream of the inlet of said pump, said valve comprising a fixed annular portion that defines a first aperture for the flow through of fluid from said first filter;

a rotatable annular portion that defines a second aperture for the flow through of fluid from said first filter, the rotatable annular portion being rotatable relative to the fixed annular portion and located adjacent to the fixed annular portion such that the first aperture and the second aperture can be selectively aligned for the flow therethrough of fluid; and an actuator configured for rotating the rotatable annular portion relative to the fixed annular portion to determine the amount of alignment of the first aperture and the second aperture such that the relative amounts of fluid flowing through said first filter and said second filter may be selectively determined.

15. A dishwashing appliance as in claim 14, further comprising:

at least one controller in communication with said actuator, said controller configured for operating said actuator at one or more predetermined times during a wash cycle, a rinse cycle, or both.

16. A dishwashing appliance as in claim 14, wherein said first filter is equipped for filtering relatively larger soil particles from fluid received from the wash chamber while said second filter is equipped for filtering relatively smaller soil particles from fluid received from the wash chamber, and wherein said appliance further comprises:

a controller in communication with said actuator, said controller configured for controlling the actuator so that the first aperture and the second aperture are aligned during a wash cycle of the appliance, said controller further configured for controlling the actuator so that the first aperture and the second aperture are not aligned during at least a portion of a rinse cycle of the appliance.

17. A dishwashing appliance as in claim 14, wherein said first filter is equipped for filtering relatively larger soil particles from fluid received from the wash chamber while said second filter is equipped for filtering relatively smaller soil particles from fluid received from the wash chamber, and wherein said appliance further comprises:

a controller in communication with said actuator, said controller configured for controlling the actuator to adjust the ratio of the amounts of fluid flowing through said first filter and said second filter during the operation of the appliance.

18. A dishwashing appliance as in claim 14, wherein said first filter is equipped for filtering relatively larger soil particles from fluid received from the wash chamber while said second filter is equipped for filtering relatively smaller soil particles from fluid received from the wash chamber, and wherein said appliance further comprises:

a controller in communication with said actuator, said controller configured for causing the actuator to rotate the rotatable annular portion so that a substantial portion of fluid flows through the first filter during a wash cycle of the appliance, said controller also configured for causing the actuator to rotate the rotatable annular portion so that a substantial portion of fluid flows through the second filter during at least part of a rinse cycle of the appliance.

* * * * *